US011746477B2

(12) United States Patent
Arvati et al.

(10) Patent No.: US 11,746,477 B2
(45) Date of Patent: Sep. 5, 2023

(54) MODULAR SECTION FOR TRACKS, IN PARTICULAR CYCLE TRACKS

(71) Applicant: REVO S.R.L., Milan (IT)

(72) Inventors: Stefano Arvati, Briosco (IT); Andrea Ariotti, Lipomo (IT); Elena Mancuso, Alcamo (IT); Marco Lucci, Milan (IT)

(73) Assignee: REVO S.R.L., Milan (IT)

( * ) Notice: Subject to any disclaimer, the term of this patent is extended or adjusted under 35 U.S.C. 154(b) by 0 days.

(21) Appl. No.: 17/286,684

(22) PCT Filed: Dec. 23, 2019

(86) PCT No.: PCT/IB2019/058893
§ 371 (c)(1),
(2) Date: Apr. 19, 2021

(87) PCT Pub. No.: WO2020/084417
PCT Pub. Date: Apr. 30, 2020

(65) Prior Publication Data

US 2021/0348343 A1 Nov. 11, 2021

(51) Int. Cl.
*E01C 15/00* (2006.01)

(52) U.S. Cl.
CPC ..... *E01C 15/00* (2013.01)

(58) Field of Classification Search
CPC ..... E01C 15/00
USPC ..... 404/34–46
See application file for complete search history.

(56) References Cited

U.S. PATENT DOCUMENTS 2,994,254 A 8/1961 Shumaker
4,501,420 A * 2/1985 Dury ..... E01C 13/045 428/17
4,556,213 A * 12/1985 Sharma ..... A63G 25/00 273/287
4,846,457 A * 7/1989 Vaux ..... E01C 5/18 52/177
5,152,632 A * 10/1992 Hawkes ..... E01C 15/00 404/20

(Continued)

FOREIGN PATENT DOCUMENTS

CN 108589459 A 9/2018
GB WO2018162877 A1 * 9/2018 ..... E01F 13/02

(Continued)

*Primary Examiner* — Raymond W Addie
(74) *Attorney, Agent, or Firm* — Pearne & Gordon LLP; Bryan M. Gallo

(57) ABSTRACT

Modular section for tracks, in particular cycling paths or the like, characterized in that it comprises at least one base module (2) having a lower surface (2*a*) which can be anchored to a constraint surface such as a ground or a road surface and an upper surface (2*b*) defining a supporting plane and lying at a higher level with respect to the constraint surface; at least one connection module (3) stably connected to a side edge (L) of the base module (2) and configured to connect with a respective junction element (4) or to a corresponding connection element (5) of at least a modular section (1) of adjacent tracks; the base module (2) and the connection module (3) also having respective front and/or rear connecting means for coupling to respective base modules (2) and connection modules (3) to realize a succession of modular sections (1) mutually connected along a development direction of the track.

18 Claims, 6 Drawing Sheets

(56) References Cited

U.S. PATENT DOCUMENTS

Figure 1:
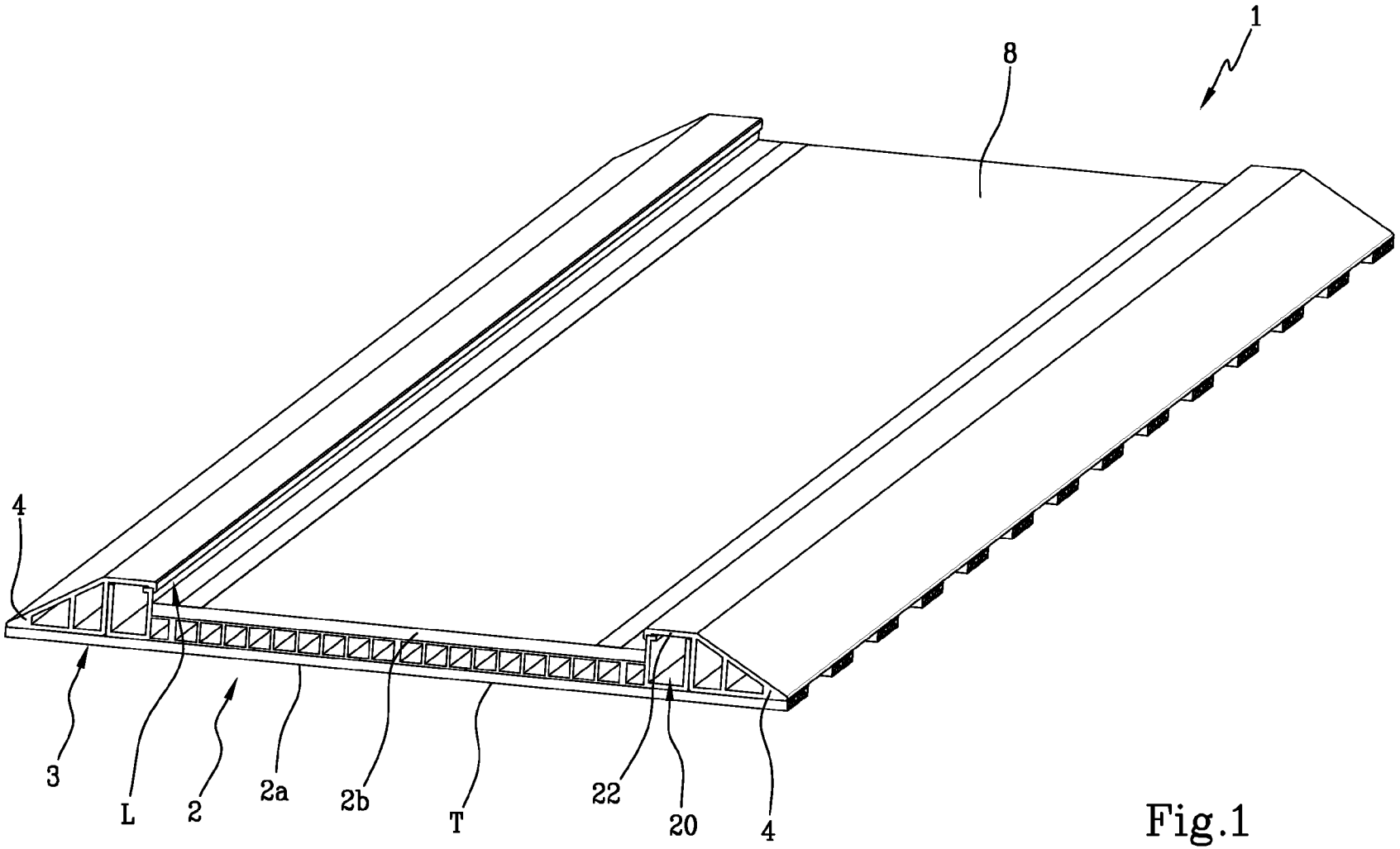

| | | | | | |
|---|---|---|---|---|---|
| 5,267,367 | A * | 12/1993 | Wegmann, Jr. | A62C 33/06 | 52/220.5 |
| 5,499,888 | A * | 3/1996 | Hawkes | E01C 5/22 | 152/209.7 |
| 5,640,821 | A * | 6/1997 | Koch | A47F 5/16 | 52/630 |
| 5,978,998 | A * | 11/1999 | Shivaram | E01F 9/696 | 404/43 |
| 6,988,848 | B2 * | 1/2006 | Arsenault | F16N 31/006 | 180/69.1 |
| 7,194,843 | B2 * | 3/2007 | Pacione | A47G 27/0475 | 52/552 |
| 7,608,313 | B2 * | 10/2009 | Solomon | E04F 15/02172 | 404/35 |
| 8,236,392 | B2 * | 8/2012 | Sawyer | E01C 3/006 | 428/17 |
| 8,288,652 | B2 * | 10/2012 | Lubanski | H02G 15/08 | 404/35 |
| 8,683,769 | B2 * | 4/2014 | Cerny | E04F 15/02194 | 52/584.1 |
| 10,036,550 | B1 * | 7/2018 | Reid | G09F 19/228 | |
| 2004/0197147 | A1 | 10/2004 | Kennedy | | |
| 2007/0119002 | A1 | 5/2007 | Baranoff | | |
| 2009/0317189 | A1 | 12/2009 | Baranoff | | |
| 2014/0193196 | A1 * | 7/2014 | Fournier | E01C 9/08 | 404/35 |
| 2014/0286704 | A1 * | 9/2014 | Bennett | E01C 5/22 | 156/60 |

FOREIGN PATENT DOCUMENTS

| | | | |
|---|---|---|---|
| KR | 20120030637 | A | 3/2012 |
| KR | 20180087603 | A | 8/2018 |
| WO | 2007062134 | A2 | 5/2007 |

* cited by examiner

MODULAR SECTION FOR TRACKS, IN PARTICULAR CYCLE TRACKS

The present invention relates to a modular section for tracks, in particular cycling paths or the like, and the relative modular track.

The invention also relates to a kit for the construction of a modular section, for tracks, in particular cycling paths or the like, and a laying method of a modular section for tracks, in particular cycling paths or the like.

Modular track refers to a track made from a plurality of modular sections operatively connected to define a transit path for people and/or vehicles.

Nowadays the increasingly careful attention of the population to physical fitness led to an increasingly felt need for pedestrian paths, suitable for activities such as running and walking, and for cycling paths.

Essentially, this implies the development of road infrastructure to encourage, promote and make safer the circulation of cyclists and runners. Said infrastructures generally have a transit route possibly well delimited by the portion of the road used for the circulation of motor vehicles.

In particular, the aforementioned transit route is defined by a transit road surface that can be made of different types of material, for example concrete or newly developed materials specifically designed to increase users' comfort.

In accordance with these requirements, the PFU, that is a material composed of end-of-life tires, which makes it possible to limit the road construction costs using components destined for disposal, is particularly widely used.

Capillarity in the territory is a fundamental characteristic that such infrastructures must possess.

In fact, to guarantee good usability in complete safety, the tracks must form a capillary network that branches off inside the housing conglomerate.

Although the request is strongly felt, the development of cycling paths, especially within the city contexts, is very often limited due to a plurality of problems intrinsically related to the installation of such infrastructures.

Disadvantageously, this installation is particularly burdensome since it requires the excavation of a portion of the soil or of the road surface to define a housing arranged to accommodate the entire structure of the track.

In other words, the tracks are commonly installed in special housings obtained inside the road surface.

The laying of the track within the aforementioned housings requires particularly long timing that generate significant inconvenience to driveability, especially in metropolitan areas often congested with traffic.

In addition, it is difficult to define a circuit compatible with the different transport utilities that can occupy the road surface, such as for example, tram rails, underground spaces, preferential lanes for taxis and other types of utilities.

Simultaneously with the laying of the track, it is often necessary the wiring of a plurality of utilities that must be housed in the subsoil, for example used for lighting the track itself, water or other types of utilities, which determines a further increase in the timing of realization and related costs.

The same disadvantages discussed for the track laying operations are found during its removal. In fact, this operation requires, in addition to the complete removal of the track, further road building works, so that the road surface, subsequently laid to replace the removed track, can be shaped and levelled to the surrounding one.

The object of the present invention is therefore to make available a modular section for tracks, in particular cycling paths or the like, able to optimize the installation process by limiting the timing and the related costs.

A further object of the present invention is to provide a modular track, a kit for the construction of a modular section for tracks and a laying method of a modular section for tracks, in particular cycling paths or the like, able to reduce the timing and costs of installation and laying.

The mentioned technical task and the stated object are substantially achieved by a modular section for tracks, in particular cycling paths or the like, comprising the features set out in one or more of the claims.

The dependent claims correspond to various possible embodiments of the invention.

Further characteristics and advantages of the present invention will be clearer from the indicative, and therefore not limiting, disclosure of a modular section for tracks, in particular cycling paths or the like.

Figure 2A:
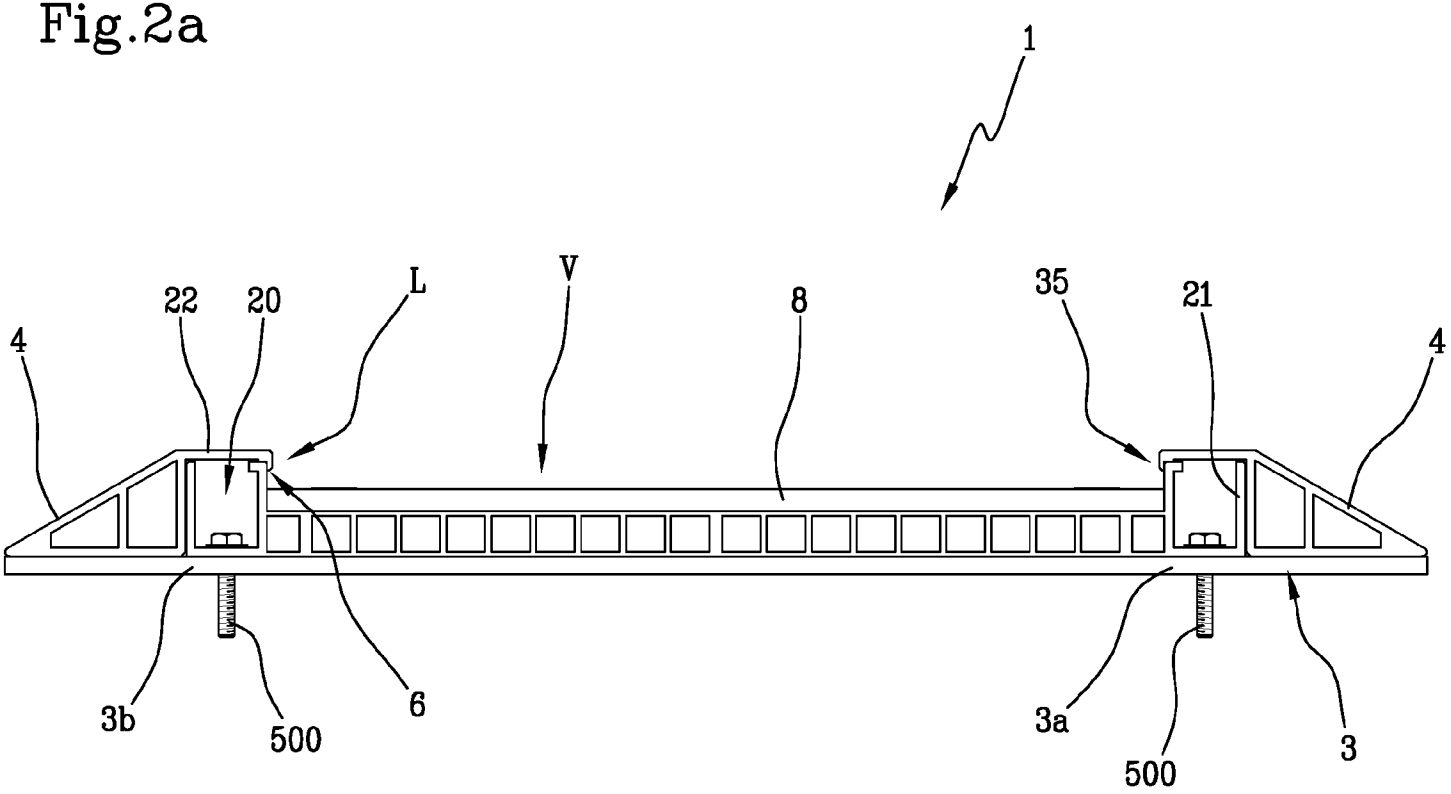
Figure 2B:
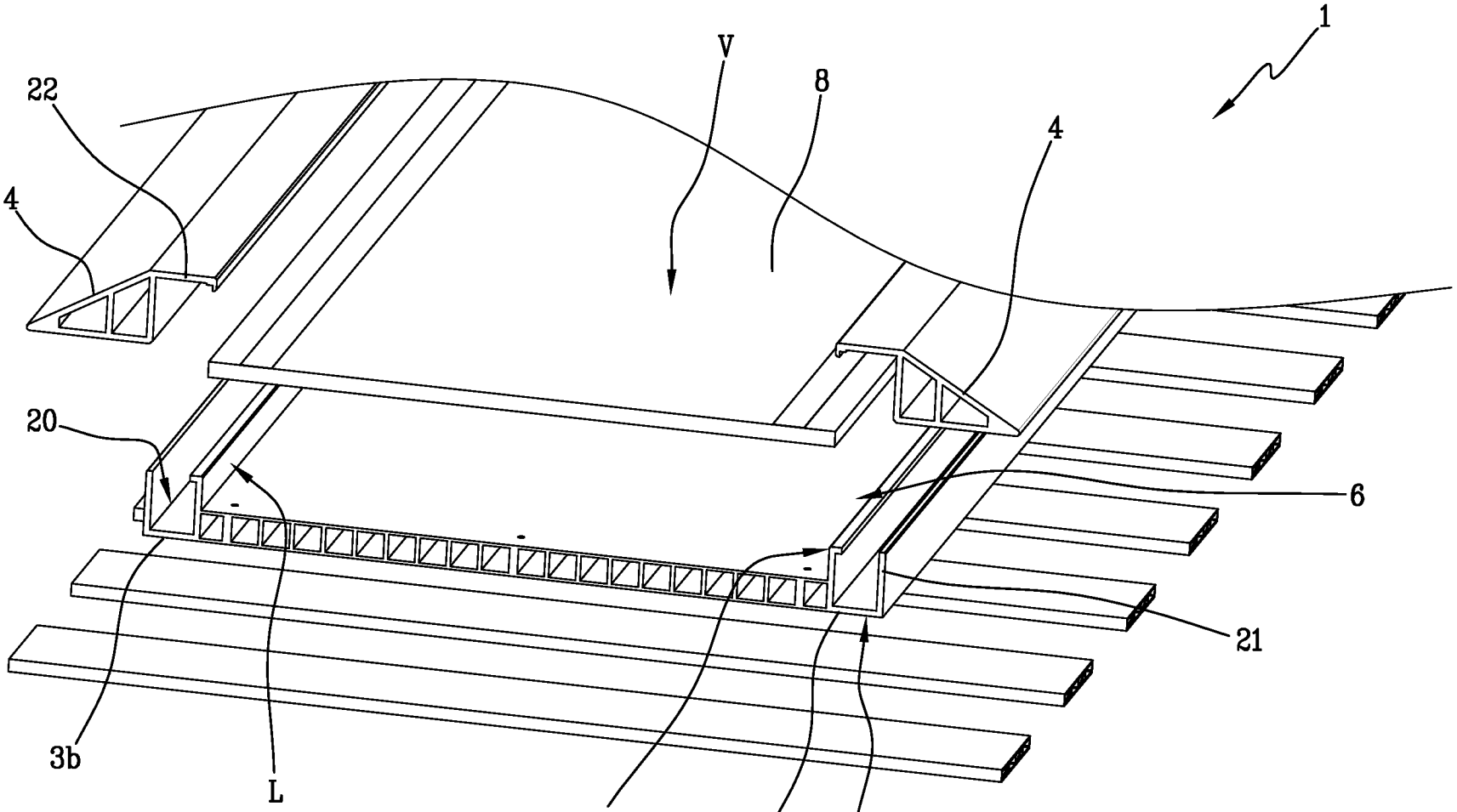

Such description will be set out hereinafter with reference to the accompanying drawings given only for illustrative and, therefore, non-limiting purpose, wherein:

FIG. 1 is a perspective view of a modular section according to the present invention;

FIG. 2*a* is a perspective view of a modular section according to a first embodiment;

FIG. 2*b* is an exploded view of the modular section of FIG. 2*a;*

Figure 3A:
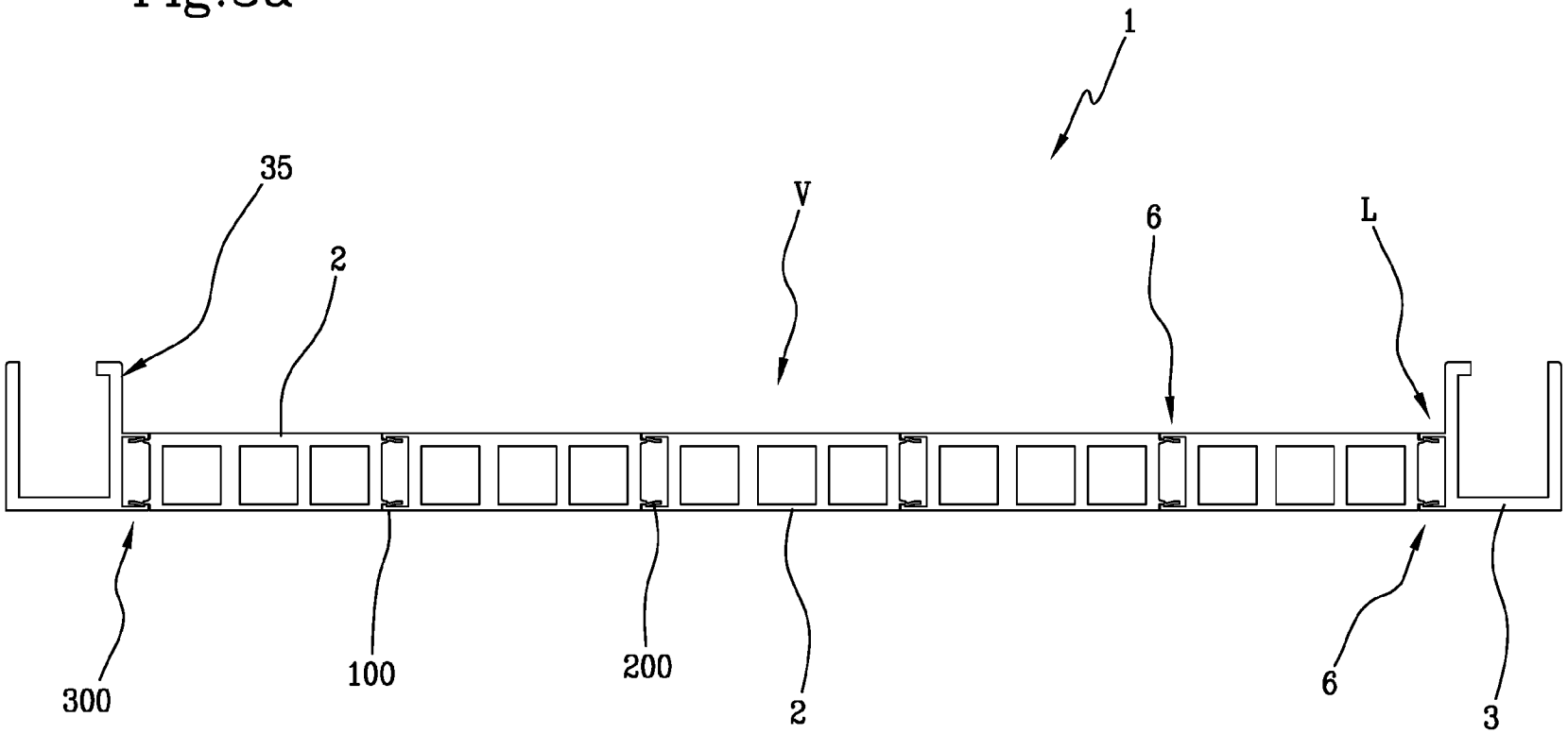
Figure 3B:
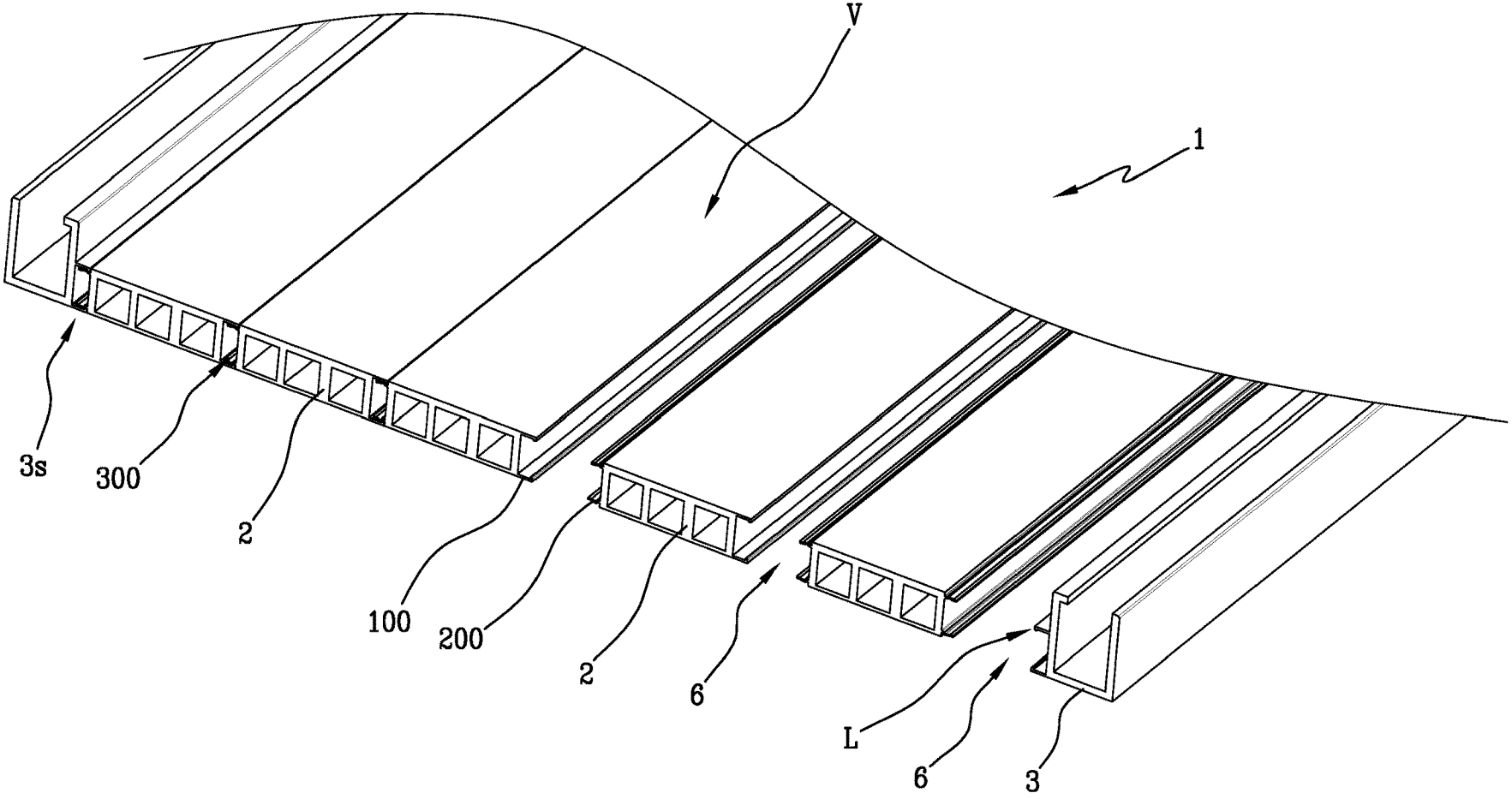

FIG. 3*a* is a perspective view of a modular section according to a particular embodiment of the present invention;

FIG. 3*b* is an exploded view of the modular section of FIG. 3*a;*

Figure 4:
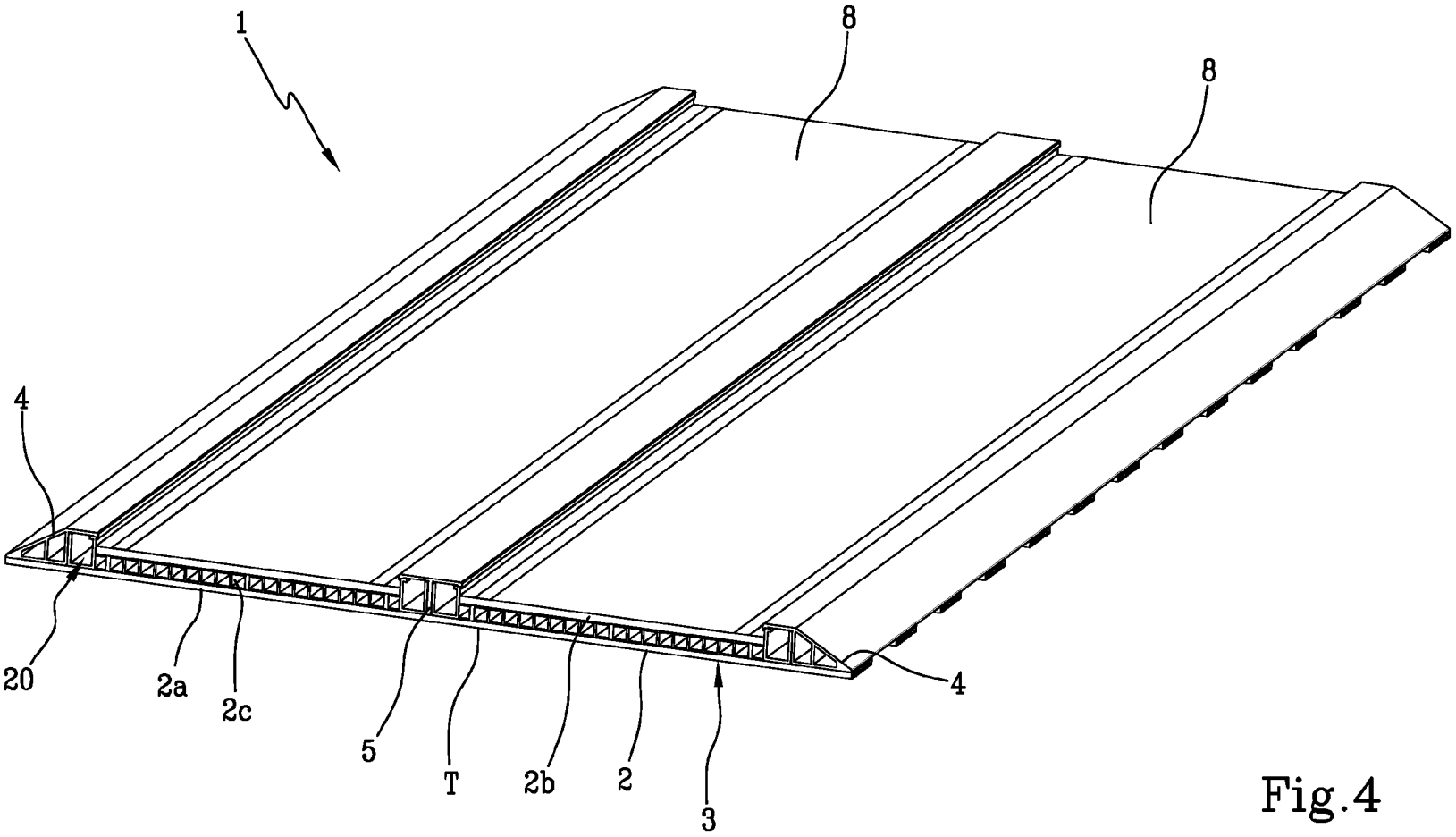

FIG. 4 is a perspective view of a modular track according to an inventive aspect of the present invention.

With reference to the accompanying figures, the reference number 1 generally indicates a modular section for tracks, in particular cycling paths or the like, hereinafter referred to as the modular section 1.

The modular section 1 comprises at least one base module (2) having a lower surface 2*a* that can be anchored to a constraint surface such as a ground or a road surface by generic anchoring means (not illustrated in the accompanying figure), for example a plurality of anchor rods, and an upper surface 2*b* defining a supporting plane and lying at a higher level with respect to said constraint surface.

Advantageously, the base module 2 can have a plurality of through cavities 2*c* extending substantially along the development direction of the modular section 1, said through cavities 2*c* reduce the quantity of constituent material limiting the production, transport and laying costs of the base module 2. Moreover, the through cavities 2*c* can be advantageously used for housing utilities of different types.

Preferably, the base module 2, which has a substantially rectangular profile, is made by means of a plastic extrusion process helping to increase the efficiency of the production cycle of the aforementioned modular section 1.

According to an alternative embodiment of the present invention and as illustrated in FIGS. 3*a*-3*b*, the modular section 1 comprises a plurality of base modules 2, preferably identical, mutually flanked transversely to the development direction of the track and defining in mutual collaboration the aforementioned upper and lower surfaces 2*b*, 2*a*.

In other words, the plurality of base modules 2 defines the supporting plane for a user.

Such plurality of base modules 2 is mutually coupled by a shape fit, preferably of a male-female type by a first coupling element 100 and a second coupling element 200.

In particular, such first and second coupling elements 100, 200 are configured to define an interspace 300. This interspace is arranged to compensate the thermal deformations of induced transversal dilation and contraction, for example by the environmental conditions, on the aforementioned first and second coupling elements, keeping the mutual coupling of the base modules 2 stable.

Advantageously, the longitudinal thermal dilation could be compensated by providing a suitable coupling, preferably a comb joint, between consecutive modular sections 1.

Preferably, a plurality of supporting sleepers "T" can be interposed between the lower surface 2*a* and the constraint surface to support the base module 2 so that the lower surface 2*a* is arranged at a high altitude with respect to the constraint surface.

Advantageously, this solution facilitates the outflow of the water which can be deposited on the constraint surface, for example upon a rainy weather condition.

Advantageously, moreover, the sleepers "T" allow to define a reference plane in the case in which the constraint surface has particular discontinuities.

The modular section 1 comprises connection modules 3 which can be connected to the side edges "L" of at least one base module 2.

As illustrated in FIG. 2*a*, the modular section 1 comprises a right connection module 3*a* and a left connection module 3*b*, preferably identical, which can be stably connected to the side edges of the base module 2.

Preferably, the connection modules 3 have a width, transversely to the development direction of the track, lower than the width of the base module 2.

Moreover, the base module 2 and the connection modules 3 have a prevalent development direction, preferably, coinciding with the development direction of the aforementioned track.

The base module 2 and connection modules 3 also have respective front and/or rear connecting means for coupling to respective base modules 2 and connection modules 3 to realize a succession of modular sections 1 mutually connected along a development direction of the track.

The base module 2 and/or the connection modules 3 can be made of recycled polymeric substances, preferably PP, PE, PET and other existing or newly designed.

The connection modules 3 are configured for connecting to junction element 4 and/or to corresponding connection elements 5 of modular sections 1 for adjacent tracks.

In particular, such junction elements 4 are configured to join the upper portion of the connection modules 3 to the constraint surface.

In other words, the junction elements 4 have surfaces, preferably inclined surfaces, configured to join the modular section 1 to the constraint surface since the modular section 1 is preferably configured to be placed laying on a ground or a road surface.

Preferably, these junction elements 4 have a ramp conformation so as to facilitate access to the track by limiting the presence of steps which very often play the role of architectural barrier.

Preferably, each connection module 3 comprises hooking means 6 to be interposed between the respective base module 2 and the respective junction element 4 and/or connection element 5 of modular sections of adjacent tracks.

According to the embodiment shown in FIGS. 1, 2*a*, 2*b*, 4, such connection modules 3 are integrally formed with the aforementioned base module 2 without altering the inventive concept underlying the present invention.

Preferably, the connection modules 3 have a box-shaped configuration for defining internally at least a longitudinal cavity 20 for housing cables and or utility transmission means.

In particular, each connection module comprises a profiled element 21 having a substantially U-shaped cross-section.

Such profiled element 21 defines an access opening to the longitudinal cavity 20.

Furthermore, the profiled element can comprise a closing element 22 reversibly engaged with the access opening. Such closing element 22 is arranged above said supporting plane.

In particular, the closing element 22 is connected to the upper portion 3*s* to define a closing condition of the cavity 20.

Advantageously, the cavity 20 allows the housing of wirings of different nature above the level of the road and without the need to carry out road surface building works.

According to the preferred embodiments of the present invention, the junction elements 4 comprise a flat portion adjoining to the inclined surface and defining said closing element 22.

Advantageously, such junction elements 4 can be easily decoupled from the connection modules 3 so as to ensure accessibility to the cavity 20 should it be appropriate to carry out maintenance works, for example.

According to alternative embodiments not present in the attached figures, the cavity 20 can have a different conformation from the one previously described without altering the inventive concept of the present invention. The connection modules 3 preferably have a greater height than the base module 2.

In particular, the connection modules 3, when connected to the base module 2, define, in cooperation with the supporting plane, a containment volume "V" laterally delimited by the upper portions 3*s* of the connection modules 3.

Such containment volume "V" is arranged to house a coating module 8 defining a transit surface for a user.

In other words, the modular section 1 can comprise at least one coating module 8, which can be housed in the aforementioned containment volume "V" arranged to define a walkable area of the modular section 1. Advantageously, the coating module 8 confers protection to the base module 2 ensuring high durability.

Advantageously, this coating module 8 can be further customized so as to define a specific transit surface depending on the use to which the track is designed.

In view of this, for example, tracks dedicated to running activities may comprise a specific coating module 8 for running and different from that suitable for a cycling path.

Preferably, the coating module 8 comprises a carpet made of recycled rubber, for example PFU.

Advantageously, the use of PFU, i.e. end-of-life tires, as a constituent component limits production costs and is a particularly environmentally friendly choice as it can be further recycled in the event of a subsequent disposal of the track.

In addition, such material can be repeatedly coloured without undergoing a degradation of the mechanical properties.

Very advantageously advertising spaces and/or passive and/or active road signs can be painted or printed on the PFU road surface, for example, so as to allow users' regular and safe circulation.

In accordance with alternative embodiments not shown in the attached figures, the coating module 8 can comprise photovoltaic panels arranged to electric energy production.

Advantageously, the photovoltaic panels can feed a plurality of optional utilities connected to the modular section 1, for example a plurality of LEDs to illuminate the path, and/or generate energy to be fed into the electrical network.

In particular, the modular section 1 can comprise an integrated lighting system, preferably having a plurality of LEDs, which guarantees a high degree of safety for the user during circulation on the modular section 1.

Advantageously, such lighting system can be managed by a dedicated unit which determines its switching on and/or off, for example based on the presence of users on the modular section 1 or on time, so as to limit energy consumption.

Preferably, the coating module 8 comprises heating elements housed in special seats formed therein and configured to melt the ice that may form on its surface in low temperature conditions.

In accordance with different embodiments of the present invention, the heating elements can be arranged in different housings formed in the modular section 1 without altering the inventive concept of the present invention.

Advantageously, the heating elements raise the level of safety for the users by keeping the transit surface free of ice.

The coating module 8 and/or the base module 2 and/or the connection modules 3 can house a plurality of sensors arranged to determine a plurality of operating conditions of the modular section 1.

Such sensors may include, for example, temperature sensors, sensors arranged to detect the humidity degree, atmospheric pressure, pollution level, wear state of the modular section 1 and the wind speed and/or of different types without that the inventive concept of the present invention is altered.

In accordance with a particular embodiment not shown in the accompanying figures, the sensors may have different locations, for example the connection modules 3 may comprise sensor means, preferably of the column type projecting above by a longitudinal shape of the connection element 5.

Such sensor means can include proximity sensors arranged to determine the presence of users or vehicles on or near the walkable path.

Advantageously, these sensors contribute to an improvement in the safety on the path allowing to signal the presence of vehicles or obstacles of any kind to the users and/or to the competent authorities.

In particular, each photovoltaic panel and/or heating element and/or sensor can comprise electrical connection means which allow a mutual connection in series or in parallel on a wiring housed, preferably, inside the connection modules 3.

Advantageously, each of the aforementioned utilities can be connected to a control unit configured to acquire the sensor signals and regulate the operation of the other utilities.

In particular, such control unit can be connected at least to a second control unit and/or to a central processing unit arranged to define a plurality of operating conditions of the modular section 1.

Moreover, the central processing unit can be configured to emit a signal relating to the operating conditions of at least one modular section 1.

Advantageously, this signal can be received by a user by means of a digital device and decoded by means of a suitable application.

Furthermore, an automatic cleaning system comprising AGV (Autonomous Guided Vehicle) type cleaning means can be provided which allows to maintain the track clean in total safety for the users. In particular, such automatic cleaning system can comprise guide cables installed, preferably, inside the modular section 1, suitable for defining a path for the movement of the cleaning means.

According to a further aspect, the present invention relates to a track comprising a series of modular sections 1 longitudinally flanked in succession and along a prevailing development direction so as to define a walkable path.

In particular, the walkable path is preferably defined by at least one coating module 8 associated on the supporting planes of a series of modular sections mutually approached.

Preferably, the track comprises two series of modular sections 1 mutually approached and active connecting means between respective connection modules mutually adjacent in a configuration wherein the two mutually connected sections form part of respective separate and flanked lanes.

In particular, the respective longitudinal cavities 20 of connection modules mutually adjacent are mutually in fluid communication and define a single channel for the aforementioned utilities.

Such profiled element 21 defines an access opening to the longitudinal cavity 20.

In accordance with alternative embodiments, the track may comprise a different number of modular sections 1 and present different types of coating modules without altering the inventive concept of the present invention.

In addition, the track can comprise at least one processing unit, interconnected to a plurality of control units, arranged to coordinate and process the signals coming from the aforementioned control units located on at least a portion of the track.

According to a further inventive aspect, the present invention relates to a kit for the construction of a modular track, in particular a cycling path or the like, comprising a plurality of the aforementioned modular sections 1 and at least one ground anchoring element extending through each modular section to engage the section itself to the constraint surface.

Preferably, the anchoring element is an anchor rod 500.

The present invention is also directed to a laying method of a modular section for tracks, in particular cycling paths or the like, comprising the steps of providing at least one modular section 1 and anchoring the modular section 1 to a constraint surface such as a ground or a road surface.

In particular, such step of anchoring the modular section is carried out by passing at least one anchor rod 500 through the modular section and until insertion into a respective blind hole formed on the constraint surface.

Advantageously, this method does not provide for the execution of excavations in the constraint surface resulting in this way easy to execute and fast to implement.

It is therefore observed that the present invention achieves the proposed aim thanks to a modular section for tracks, in particular cycling paths or the like, having a plurality of modules and cooperating elements to optimize the installation process by limiting the timing and costs involved.

In particular, the laying of the modular section for the track takes place above the road surface, reducing the execution timing.

Advantageously, this operation does not require excavation and road surface building works, thus reducing the resulting operating costs.

Advantageously, especially in large urban conglomerates, which are often congested with traffic, the reduced laying timing limit traffic disruptions for the community.

In addition, the modular section of the present invention is constrained to the soil by means of common anchoring elements and shows a minimum impact on the territory.

Advantageously, the removal of the modular section may not require a road surface building work. In particular, the entire track or the modular sections can be repositioned in a different location or completely recycled in the event of disposal.

Moreover, the special seats of the modular section allow to house a plurality of utilities.

Advantageously, the seats, besides conferring protection to the aforementioned utilities, are easy to assemble and disassemble so as to simplify the performance of the various maintenance operations.

The invention claimed is:

1. Modular section for tracks or cycling paths, comprising:

at least one base module (2) having a lower surface (2*a*) that can be anchored to a constraint surface and an upper surface (2*b*) defining a supporting plane and lying at a higher level with respect to said constraint surface;

at least one connection module (3) that can be stably connected to a side edge (L) of said at least one base module (2) and configured to connect with a respective junction element (4) or to a corresponding connection element (5) of at least one adjacent modular section (1) of tracks;

said base module (2) and said connection module (3) also having respective front and/or rear connecting means for coupling to respective base modules (2) and connection modules (3) to realize a succession of modular sections (1) mutually connected along a development direction of said track;

wherein each said connection module (3) has a box-shaped configuration for internally defining at least a longitudinal cavity (20) for housing cables and/or utility transmission means; and further comprising at least one anchoring element to engage the lower surface (2*a*) to said constraint surface, said anchoring element being an anchor rod (500).

2. Modular section according to claim 1, wherein said modular section (1) further comprises at least one coating module (8) associated on said supporting plane and defining a walkable area of said modular section (1).

3. Modular section according to claim 2, wherein said connection modules (3) have a greater height with respect to said base module (2) in such a way that said connection modules (3), when connected to said at least one base module (2), define, in cooperation with said supporting plane, a containment volume (V) laterally delimited by upper portions (3*s*) of said connection modules (3); said coating module (8) being housable within said containment volume (V).

4. Modular section according to claim 2, wherein said coating module (8) comprises a carpet made of PFU recycled rubber.

5. Modular section according to claim 2, wherein said coating module (8) includes photovoltaic panels and/or heating elements and/or sensors, each photovoltaic panel and/or heating element comprising electrical connection means.

6. Modular section according to claim 1, comprising a plurality of base modules (2), mutually flanked transversely to said development direction of said track and defining in mutual collaboration said upper and lower surfaces (2*b*, 2*a*).

7. Modular section according to claim 6, wherein said connection modules (3) have a width, transversely to the development direction of the track, which is lower than said base module (2).

8. Modular section according to claim 1, wherein each connection module (3) comprises hooking means (6) to be interposed between the respective base module (2) and the respective junction element (4) and/or connection element (5) of modular sections (1) of adjacent tracks.

9. Modular section according to claim 1, wherein said at least one base module (2) and/or said connection modules (3) are made of recycled PP or PET polymer.

10. Modular section according to claim 1, wherein each connection module (3) comprises a profiled element (21) having a substantially U-shaped cross-section conformation; said profiled element (21) defining an access opening to said longitudinal cavity (20).

11. Modular section according to claim 10, wherein said profiled element (21) comprises a closing element (22) reversibly engaged to said access opening; said closing element (22) being arranged above said supporting plane.

12. Modular section according to claim 1, wherein the junction elements (4) can be coupled to said connection modules (3) and defining junction surfaces with the constraint surface.

13. Modular section according to claim 11, wherein the junction elements (4) can be coupled to said connection modules (3) and defining junction surfaces with the constraint surface, and wherein said junction elements (4) comprise a flat portion adjoining to the inclined surface and defining said closing element (22).

14. Modular section according to claim 1, wherein said connection modules (3) comprise sensor means, selected from: temperature sensors, humidity sensors, pressure sensors, pollution sensors, proximity sensors.

15. Modular track comprising at least one series of modular sections (1) according to claim 1, said sections being arranged longitudinally flanked in sequence and along a prevailing development direction defining a walkable path.

16. Modular track according to claim 15, wherein said walkable path is defined by at least one coating module (8) associated on the supporting planes of a series of modular sections (1) mutually approached.

17. Modular track according to claim 15, comprising two series of sections mutually approached and active connecting means between respective connection modules (3) mutually adjacent; said series of sections defining a configuration wherein the two mutually connected sections form part of respective separate and flanked lanes.

18. Laying method of a modular section for tracks or cycling paths, comprising the steps of:

providing at least one modular section (1) according to claim 1; and anchoring the modular section (1) to a constraint surface;

said step of anchoring the modular section being carried out by passing at least one anchor rod (500) through the modular section and until insertion into a respective blind hole formed on the constraint surface.

* * * * *